United States Patent [19]

Kevius

[11] Patent Number: 4,922,153

[45] Date of Patent: May 1, 1990

[54] METHOD OF, AND DEVICE FOR, REDUCING MAGNETIC STRAY FIELDS

[75] Inventor: Bruno Kevius, Spånga, Sweden

[73] Assignee: U.S. Philips Corporation, New York, N.Y.

[21] Appl. No.: 241,751

[22] Filed: Sep. 7, 1988

Related U.S. Application Data

[63] Continuation of Ser. No. 21,869, Mar. 4, 1987, abandoned.

[30] Foreign Application Priority Data

Mar. 7, 1986 [SE] Sweden ..... 8601072

[51] Int. Cl.[5] ..... H01J 29/06

[52] U.S. Cl. ..... 315/8; 315/85

[58] Field of Search ..... 315/8, 85; 335/210, 335/211, 212, 213, 214

[56] References Cited

U.S. PATENT DOCUMENTS

| | | | |
|---|---|---|---|
| 3,340,443 | 9/1967 | Rieth et al. | 315/8 |
| 3,735,193 | 5/1973 | Ikeuchi | 315/370 |
| 3,947,632 | 3/1976 | Giger et al. | 315/8 |
| 4,380,716 | 4/1983 | Romeo et al. | 315/8 |
| 4,634,930 | 1/1987 | Toshiyasu et al. | 315/8 |
| 4,636,911 | 1/1987 | Truskalo | 315/8 |

FOREIGN PATENT DOCUMENTS

| | | |
|---|---|---|
| 0039502 | 11/1981 | European Pat. Off. . |
| 2146071 | 3/1973 | Fed. Rep. of Germany . |

*Primary Examiner*—Robert L. Griffin
*Assistant Examiner*—T. Salindong
*Attorney, Agent, or Firm*—Leroy Eason; Algy Tamoshunas

[57] ABSTRACT

A method of, and a device for, reducing the magnetic stray field generated in the vicinity of the faceplate of a cathode ray tube by the deflection current in the deflection coils of the tube. A current loop (4) is arranged at a distance from the deflection coils and is supplied with current having a time function substantially coinciding with the time function of the deflection current. The stray field is thereby neutralized to a large extent in a region extending beyond the position of the current conductor (4) in a direction away from the faceplate.

8 Claims, 2 Drawing Sheets

METHOD OF, AND DEVICE FOR, REDUCING MAGNETIC STRAY FIELDS

This is a continuation of application Ser. No. 021,869, filed Mar. 4, 1987, now abandoned.

BACKGROUND OF THE INVENTION

1. Field of the Invention

The invention relates to a method of reducing magnetic stray fields, and to a device for reducing magnetic stray fields near a cathode ray tube.

2. Description of the Related Art

In magnetic field generating coils, deflection coils of cathode ray tubes, power supplies and other devices, undesired magnetic stray fields are generated. These stray fields may have a prejudicial influence upon the operation of adjacent equipment. It has been discovered, for example, that the magnetic field from a power supply unit may disturb the operation of an adjacent compact disc reproducing apparatus. Some investigations of the influence of magnetic fields on human beings and animals have been interpreted as showing that injuries could be caused by the magnetic field from, for example, a cathode ray tube.

SUMMARY OF THE INVENTION

It is an object of the invention to provide a reduction of the stray field produced at a distance from a magnetic field generating means.

According to the present invention there is provided a method of reducing a magnetic stray field, characterized in that a current having substantially the same time function as that of the current supplied to the stray field generating means is supplied to a current conductor which is positioned at a distance from the stray field generating means. The current in such conductor thereby generates a magnetic field which neutralizes the stray field at least in a region situated beyond the current conductor relative to the stray field generating region.

A device for carrying out the method when the magnetic stray field occurs near a cathode ray tube and originates from the deflection coils of the deflection unit is characterized in that a current conductor is arranged in the vicinity of the face plate of the cathode ray tube, the current conductor being supplied with a current having a time function corresponding substantially to the time function of the stray field generating current.

In one embodiment of the device, the current conductor has a horizontal section arranged in the vicinity of the upper front edge of the cathode ray tube and another horizontal section arranged in the vicinity of the lower front edge of the cathode ray tube. Magnetic measurements made with this embodiment has shown a high reduction of the magnetic field in front of the cathode ray tube. Another feature of this embodiment is that the arrangement of the current conductor is easy to implement.

BRIEF DESCRIPTION OF THE DRAWINGS

The present invention will now be described in more detail, by way of example, with reference to the accompanying drawings, in which.

DESCRIPTION OF THE PREFERRED EMBODIMENTS

Figure 1:
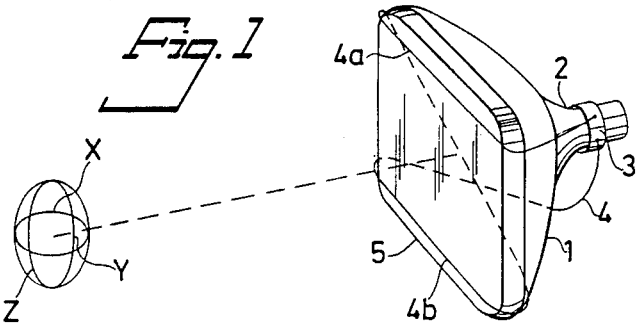
FIG. 1 is a perspective, diagrammatic view of a cathode ray tube.

The cathode ray tube 1 shows in FIG. 1 is of conventional type. A deflection unit 3 is located on a neck 2 of the cathode ray tube 1. A stray field reduction current conductor 4 is arranged in the vicinity of a face plate 5 of the cathode ray tube 1. The conductor 4 can be attached to or carried by the faceplate 5. The current conductor 4 is coupled to the deflection unit 3 in order to be supplied with a current which has substantially the same variation with time, hereinafter termed the time function, as the current supplied to the coils 6*a* to 6*d* (FIGS. 3*a* to 3*d*) of the deflection unit 3. Optionally the current supply to the conductor may be via intermediate couplings. As shown in FIG. 1 a section 4*a* of the current conductor 4 is attached to or in close proximity with the upper front edge of the faceplate of the cathode ray tube and another section 4*b* is attached to or in close proximity with the lower front edge of the cathode ray tube faceplate. The current conductor 4 may consist of one revolution or loop as shown in FIG. 1. However, the current conductor 4 may consist of a multiplicity of revolutions or loops if this is made necessary because, for example, of the high strength of the cathode ray tubes stray field or the electrical characteristics of the tube. By locating the current loop as shown in FIG. 1, it is possible to obtain a very effective reduction of the stray field generated in the deflection coils of the deflection unit 3 during the line deflection.

Figure 2:
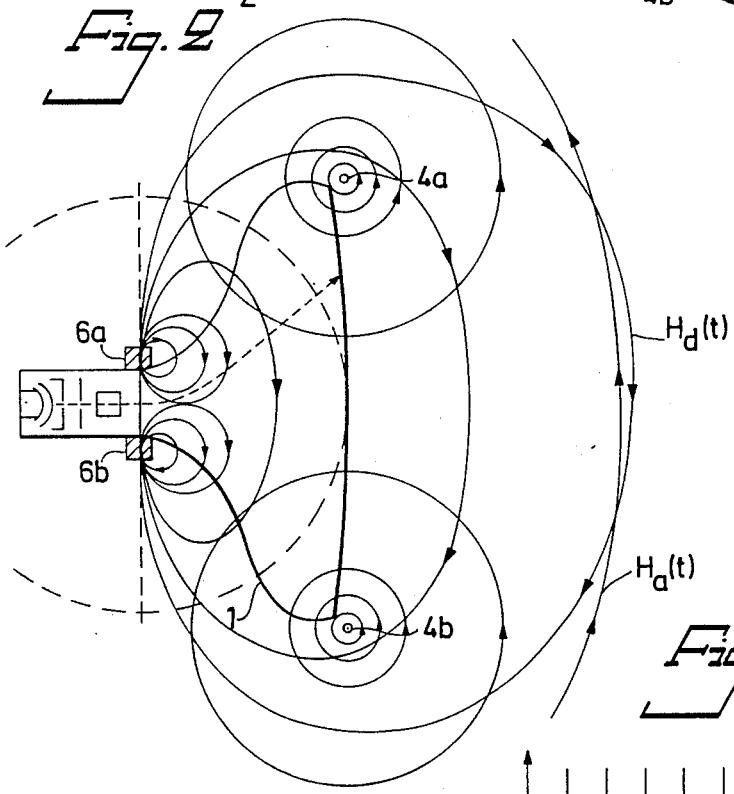
FIG. 2 illustrates stray fields and reducing magnetic fields in a vertical plane.

By means of magnetic field lines FIG. 2 shows the presence of the stray field generated in the deflection unit by the deflection coils and the reducing magnetic field generated by the current conductor in a vertical plane transverse to the front edge of the cathode ray tube. The stray deflection field has been denoted by $H_d(t)$ and the reduction magnetic field has been denoted by $H_a(t)$. As is apparent from FIG. 2, the stray field generated by the deflection unit has its highest strength closest to the deflection coils 6*a*, 6*b*. The reduction magnetic field generated by the horizontal sections 4*a*, 4*b* of the current conductor has its highest strength adjacent to the front edge of the cathode ray tube 1. The strength of the reduction magnetic field is adjusted so that its field strength in the aforesaid vertical plane at some distance in front of the cathode ray tube is of substantially the same order of magnitude as the stray field at the same distance, i.e. $H_a(t) = -H_d(t)$. It is to be noted that the deflection field at the said distance consists of the stray field. The above arrangement results in the strength of the reduction magnetic field being much lower than the strength of the deflection field in a location adjacent to the deflection unit, i.e., $|H_a(t)| < |H_d(t)|$. This is of great importance to the operation of the cathode ray tube and means that the introduced reduction magnetic field does not in any substantial degree affect the operation of the deflection field and that its influence on the normal operation of the cathode ray tube is quite negligable.

FIGS. 3*a* to 3*d* show examples of ways in which the current conductor 4 may be coupled electrically to the deflection unit and arranged with respect to the face plate 5 of the cathode ray tube. The terminals *7a*, *7b*, *7c* and *7d* denote the normal connecting terminals of the deflection unit.

Figure 3A:
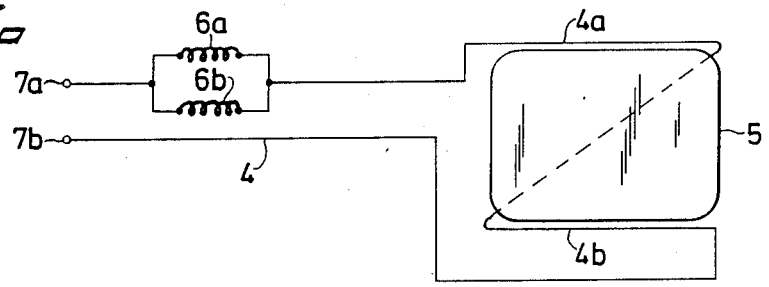
FIGS. 3*a* to 3*d* are embodiments of the connection of the current conductor to the deflection coils of a cathode ray tube, and FIG. 4 are comparative graphs of measured magnetic fields in front of a cathode ray tube with and without the use of the magnetic field reduction current conductor.

The current conductor 4 according to FIG. 3*a* is connected in series with deflection coils 6*a*, 6*b* and has two horizontal sections 4*a*, 4*b* attached to or in close proximity with the upper and lower edges, respectively, of the face plate.

Figure 3B:
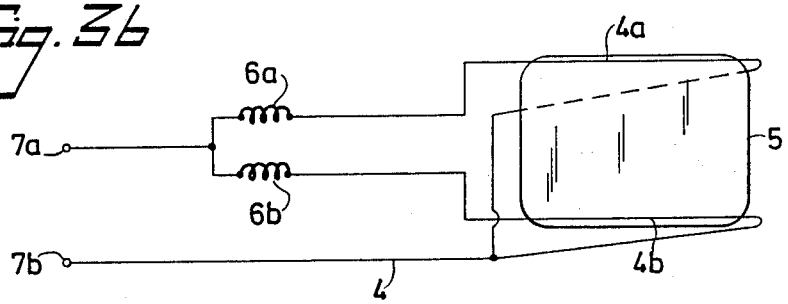

In the embodiment according to FIG. 3*b*, the deflection coils 6*a*, 6*b* are provided with individual compensation. The deflection coil 6*a* is coupled in series with an upper horizontal current conducting section 4*a* and the deflection coil 6*b* is coupled in series with a lower horizontal current conducting section 4*b*.

Figure 3C:
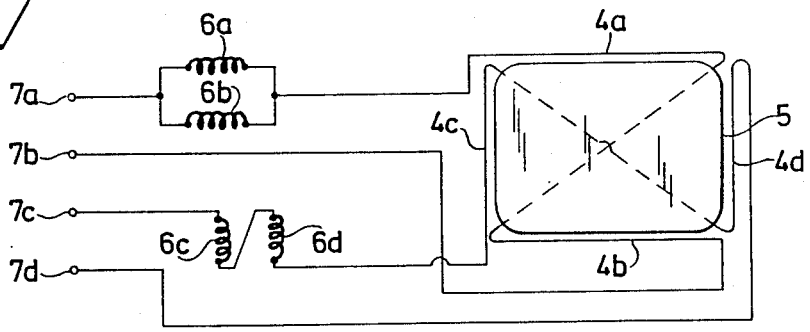

In the embodiment according to FIG. 3*c* there are provided horizontal current conducting sections 4*a*, 4*b* as well as vertical current conducting sections 4*c*, 4*d*, all of which are attached to or in close proximity with the edges of the face plate 5 of the cathode ray tube. The current conducting sections 4*a*, 4*b* are coupled in series with deflection coils 6*a*, 6*b* while the current conducting sections 4*c*, 4*d* are coupled in series with the deflection coils 6*c* and 6*d*.

Figure 3D:
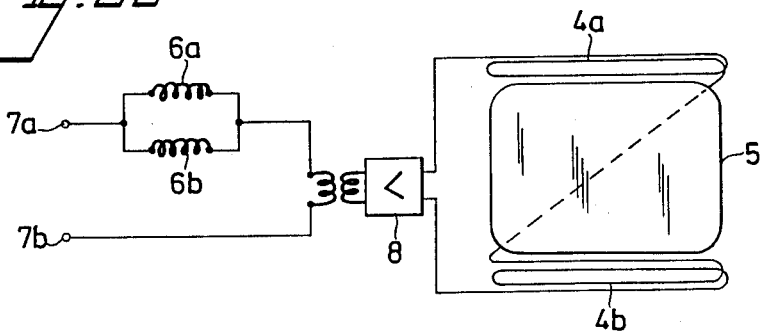

The embodiment according to FIG. 3*d* shows a controlled current source 8 arranged between the deflection coils 6*a*, 6*b* and the current conducting section 4*a*, 4*b*. The current conducting sections 4*a*, 4*b* in this case consist of a plurality of revolutions or loops.

By means of the arrangement described above with reference to the FIGS. 3*a* to 3*d* a current may be applied to the current conductor 4 in a simple way, the current having a time function which substantially coincides with the time function of the current through the deflection coils 6*a*, 6*b*.

Figure 4:
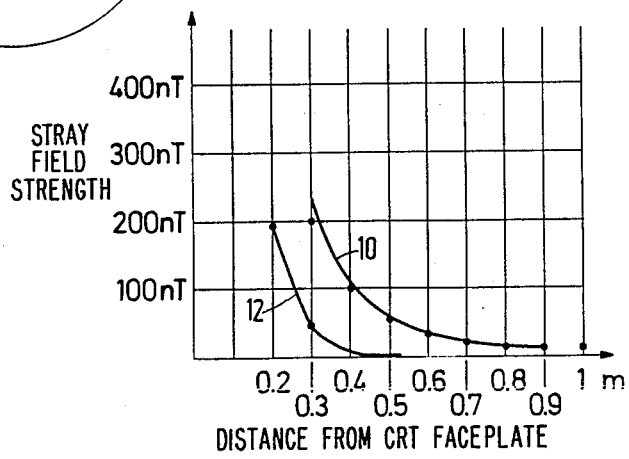

FIG. 4 is a graph showing the results of measurements performed on a test arrangement. On the horizontal axis, the abscissa, of the graph, the distance from the cathode ray tube has been indicated, while the vertical axis, the ordinate, indicates the measured magnetical field in nT (nanotesla). The vertical magnetic field in front of the cathode ray tube has been measured at different distances from a cathode ray tube without the presence of the magnetic field reduction current conductor 4, the upper curve 10, and in the presence of the magnetic field reduction current conductor, the lower curve 12.

A substantial reduction of the magnetic field may be observed. At a distance of 0.4 m from the front surface of the cathode ray tube, for example, the difference between a previously known cathode ray tube and a cathode ray tube provided with a current conductor 4 is approximately 100 nT. It is also to be noted that by means of the method in accordance with the invention the measured magnetic field is only about one tenth of the original field at the said distance of 0.4 m.

As stated above the measurements shown in FIG. 4 were made on the vertical magnetic field, the y-direction (see FIG. 1). Reductions of the field in the x-direction and the z-direction (see FIG. 1) have also been measured. Also in these directions it has been observed that there is some reduction of the measured magnetic field even if it is less pronounced.

The reduction field may, as stated above, be utilized to reduce the magnetic stray field deriving from the line deflection field. However, the method in accordance with the invention may also be used to reduce other stray fields deriving from, for example, the picture scan.

What is claimed is:

1. A device for reducing a magnetic stray field which is produced over a distance in front of the faceplate of a cathode ray tube and originates from deflection currents applied to deflection coils of the tube by a deflection circuit during operation of the tube; such faceplate having upper, lower, left and right edges; such deflection current varying with time in accordance with a time function; characterized in that such device comprises: a current conductor which is arranged on or in close proximity to said faceplate of said cathode ray tube; and circuit means for supplying to said current conductor a current which has a time function substantially the same as the time function of the stray field generating deflection currents supplied to said deflection coils, so that said current conductor continuously produces a magnetic field over said distance in front of the faceplate of said cathode ray tube substantially equal to but opposing said stray field.

2. A device for reducing a magnetic stray field which is produced at a distance from the face plate of a cathode ray tube originating from deflection current supplied to deflection coils of the tube by a deflection circuit during operation of the tube; such faceplate having upper, lower, left and right edges; such deflection current varying with time in accordance with a time function; characterized in that such device comprises: a current conductor which is arranged on or in close proximity to said face plate of said cathode ray tube; and circuit means for supplying to said current conductor a current which has a time function substantially the same as the time function of the stray field generating deflection current supplied to said deflection coils, so that said current conductor produces a magnetic field substantially equal to but opposing said stray field.

3. A device as claimed in claim 1, characterized in that said current conductor is provided with a vertical section arranged on or in close proximity to said left front edge of said cathode ray tube face plate and with another vertical section arranged on or in close proximity to said right front edge of said cathode ray tube face plate.

4. A device as claimed in claim 1, characterized in that the current conductor consists of a single revolution.

5. A device as claimed in claim 1, characterized in that the current conductor consists of a multiplicity of revolutions.

6. A device as claimed in claim 1, characterized in that said circuit means couples said conductor in series with the deflection coils of the tube.

7. A device as claimed in claim 1, characterized in that said circuit means comprises a current source coupled to said conductor, the current source being controlled by the deflection current supplied by the deflection circuit.

8. In an arrangement comprising a cathode ray tube having an envelope including a neck connected to a faceplate, a magnetic deflection yoke being mounted on said envelope, and means for supplying a deflection current to said deflection yoke for operating said cathode ray tube but which generates undesired stray magnetic fields outside said envelope over a distance in front of said faceplate; the improvement comprising: a current conductor which passes along at least two opposite edges of said faceplate, and means for supplying a current to said current conductor having a time function substantially the same as that of said deflection current and producing a magnetic field over said distance in front of said faceplate which continuously opposes and is of substantially the same magnitude as the stray magnetic field generated by said deflection yoke over said distance from said faceplate, thereby substantially neutralizing such stray field.

* * * * *